US007803024B2

(12) United States Patent
Su

(10) Patent No.: US 7,803,024 B2
(45) Date of Patent: Sep. 28, 2010

(54) FUEL EFFICIENT POWER SYSTEM FOR ELECTRIC BOAT

(75) Inventor: Jiin Juh Su, Taichung (TW)

(73) Assignee: Jin Tzeng Woo, Changhua (TW)

( * ) Notice: Subject to any disclaimer, the term of this patent is extended or adjusted under 35 U.S.C. 154(b) by 47 days.

(21) Appl. No.: 12/395,628

(22) Filed: Feb. 28, 2009

(65) Prior Publication Data

US 2010/0221962 A1 Sep. 2, 2010

(51) Int. Cl.
*B63H 21/17* (2006.01)

(52) U.S. Cl. ..... 440/6; 440/3

(58) Field of Classification Search ..... 440/3, 440/6; 290/43, 44, 54, 55
See application file for complete search history.

(56) References Cited

U.S. PATENT DOCUMENTS 1,297,130 A * 3/1919 Emmet ..... 440/3
4,095,665 A * 6/1978 Armfield ..... 318/139
4,928,227 A * 5/1990 Burba et al. ..... 318/12
5,214,358 A * 5/1993 Marshall ..... 318/139
5,616,056 A * 4/1997 Meissner ..... 440/3
7,147,523 B2 * 12/2006 Mori et al. ..... 440/3

* cited by examiner

*Primary Examiner*—Lars A Olson

(57) ABSTRACT

Fuel efficient power system for electric boat is provided. In starting a clutch is not activated if a drive shaft of an electric motor does not rotate at a predetermined speed, a power controller gradually increases a current output to the motor until the drive shaft rotates at the predetermined speed, the third clutch is activated to transmit rotation of the drive shaft to an electrical generator, and the activated generator charges one low rechargeable battery. In response to activating a first clutch rotation of the drive shaft is transmitted to a first shaft, a bevel gear clutch is activated to transmit rotation of the first shaft to a propeller via a reduction gear. In response to moving the boat the first clutch is disengaged and a second clutch is engaged for transmitting rotation of the drive shaft to the second shaft, and a gearbox for increasing propeller speed.

4 Claims, 2 Drawing Sheets

FUEL EFFICIENT POWER SYSTEM FOR ELECTRIC BOAT

BACKGROUND OF THE INVENTION

1. Field of Invention

The invention relates to the power system of small marine vessels and more particularly to an electric boat, one for carrying visitors on touring purposes on a lake, driven by a battery powered DC electric motor in cooperation with an alternator and rechargeable battery assemblies so as to have a better fuel economy and greatly reduce pollution to the environment (e.g., lake).

2. Description of Related Art

Most ships and boats are powered by electric motors. Some boats are powered by an alternator and an electric motor. However, these conventional boats are uneconomical in terms of fuel efficiency. Thus, the need for improvement still exists.

U.S. Pat. No. 5,199,912 discloses an electric power system for marine vessels. Further, U.S. Pat. No. 5,679,045 discloses an arrangement for transferring electric current to a propulsion device provided with an electric motor in a ship or equivalent.

SUMMARY OF THE INVENTION

It is therefore one object of the invention to provide a fuel efficient power system for an electric boat.

The above and other objects, features and advantages of the invention will become apparent from the following detailed description taken with the accompanying drawings.

DETAILED DESCRIPTION OF THE INVENTION

Figure 1:
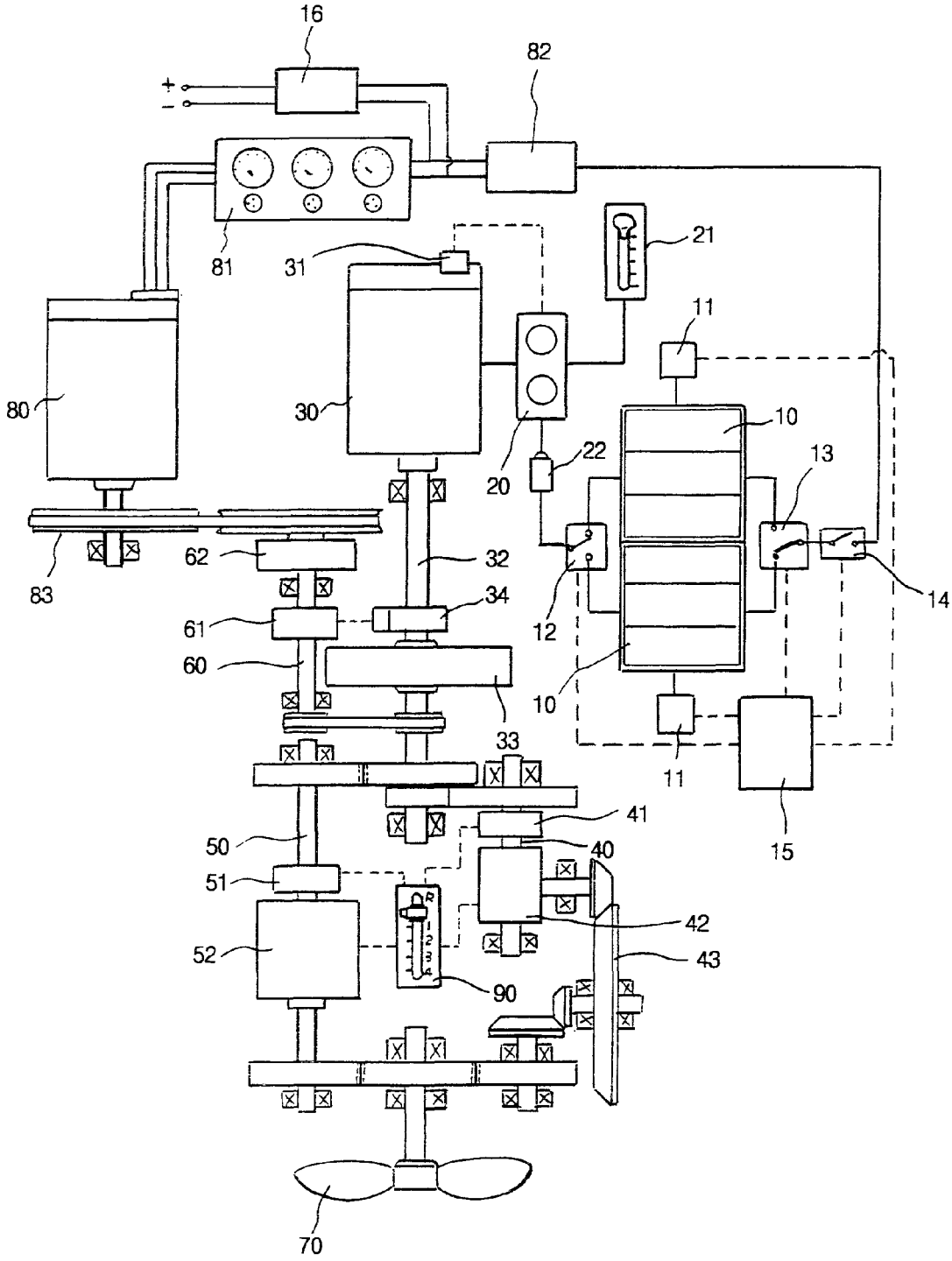
FIG. 1 is schematic view of a power system of an electric boat according to the invention.
Figure 2:
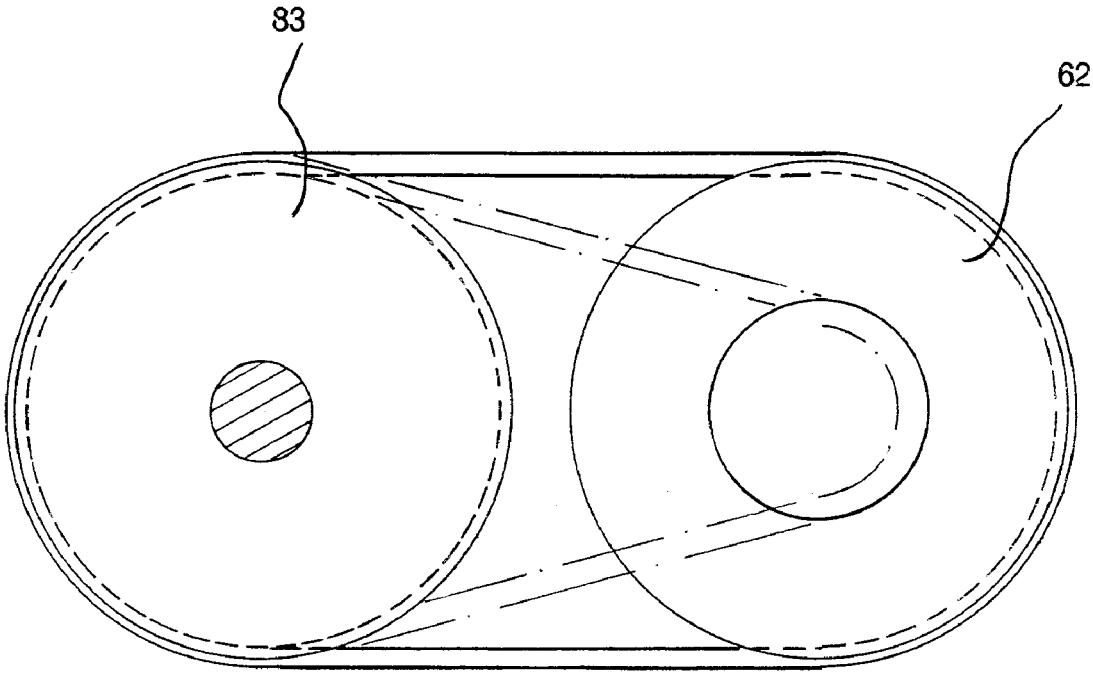
FIG. 2 is a side elevation in part section of the electrical generator and the continuously variable transmission of FIG. 1.

Referring to FIGS. 1 and 2, a fuel efficient power system for an electric boat in accordance with the invention comprises the following components as discussed in detail below.

Two rechargeable battery assemblies 10 are provided. An auxiliary alternator 31 is mounted on and driven by an electric motor (e.g., DC motor) 30. Also, the auxiliary alternator 31 is electrically connected to a power controller 20. A drive shaft 32 of the electric motor 30 is provided with a rotational speed measurement device 34 and a distal flywheel 33. Also, first, second, and third shafts 40, 50, and 60 are operatively connected to the drive shaft 32. A first clutch 41 and a bevel gear clutch 42 are operatively connected to the first shaft 40. A reduction gear 43 is in gear connection to the bevel gear clutch 42 so as to releasably rotate the shaft of a propeller 70. A second clutch 51 and a gearbox 52 are operatively connected to the second shaft 50 so that the shaft of the propeller 70 can be releasably rotated by the second shaft 50. A third clutch 61 is operatively connected to the third shaft 60. The third clutch 61 is controlled by the rotational speed measurement device 34 so as to determine whether an electrical generator 80 should be driven by the third shaft 60 or not. A control panel 81 is electrically connected to the electrical generator 80. A transformer 82 has one end electrically connected to the control panel 81 and the other end electrically connected to either rechargeable battery assembly 10 via a second switch 14 and a first switch (e.g., a toggle switch) 13. The electric motor 30 may be activated to rotate its drive shaft 32 to activate the electrical generator 80. The rotation of the drive shaft 32 may additionally rotate the propeller 70. That is, either rechargeable battery assembly 10 is charged irrespective of the rotation of the propeller 70.

The third clutch 61 is not activated if the rotational speed of the drive shaft 32 measured by the rotational speed measurement device 34 does not reach a predetermined value. Initially, i.e., the electric motor 30 is starting up with the drive shaft 32 rotating at low speed, the power controller 20 may gradually increase a current output to the electric motor 30 based on an output voltage of the auxiliary alternator 31. That is, the output voltage of the auxiliary alternator 31 gradually increases as the drive shaft 32 increases its speed. And in turn, more electric power is supplied to the electric motor 30 via the power controller 20. Also, the generator 80 is not driven by the electric motor 30 during the start-up. This can prevent the electrical generator 80 from sharing load of the electric motor 30 via the third shaft 60 before the drive shaft 32 rotates at the predetermined rotational speed. Also, load is not applied to both the first and second shafts 40, 50. The drive shaft 32 may rotate at its full speed, i.e., having reached the predetermined rotational speed, after the electric motor 30 finishing its start-up. Further, the rotational speed measurement device 34 measures same. And in turn, the third clutch 61 is activated to transmit rotation of the drive shaft 32 to the electrical generator 80. The activated electrical generator 80 may then generate electricity which is in turn used to charge either rechargeable battery assembly 10 via the control panel 81 and the transformer 82. This means that electricity generated by the electrical generator 80, which is driven by the drive shaft 32, is supplied to either rechargeable battery assembly 10 when the electric motor 30 has finished start-up but the boat equipped with the power system of the invention has not moved. As an end, energy is conserved.

In response to activating the first clutch 41 to slowly forward or backward move the boat, rotation of the drive shaft 32 is transmitted to the first shaft 40. Also, the bevel gear clutch 42 is activated to transmit the rotation of the first shaft 40 to the propeller 70 via the reduction gear 43. As a result, the boat starts to move forward or backward in a low energy consumption fashion. The drive shaft 32 may suddenly greatly reduce its rotational speed when the propeller 70 begins to rotate due to large friction during the above operation. The third clutch 61 may immediately activate to disengage from the third shaft 60 if this occurs. As a result, rotation of the third shaft 60 is stopped from transmitting to the electrical generator 80. That is, the output torque of the drive shaft 32 is not transmitted to the electrical generator 80. Hence, the whole rotating force of the drive shaft 32 transmits to the propeller 70. As a result, the propeller 70 may successfully begin to rotate.

After moving the boat successfully, the first clutch 41 is disengaged and the second clutch 51 is engaged as a replacement. Hence, rotation of the drive shaft 32 is transmitted to the second shaft 50. And in turn, the gearbox 52 can be operated to increase the rotational speed of the propeller 70. As a result, the boat moves faster. It is noted that the third clutch 61 may begin to activate when the drive shaft 32 rotates at a speed equal to or higher than the predetermined rotational speed as measured by the rotational speed measurement device 34 irrespective of the rotation of the propeller 70 being driven by the drive shaft 32 via the first shaft 40 or the second shaft 50. The electrical generator 80 is then driven as a result of the activation of the third clutch 61. And in turn, either rechargeable battery assembly 10 is charged by the activated electrical generator 80. This is an energy saving characteristic of the invention.

A gear shift 90 is adapted to control the engagement and disengagement of the first clutch 41 and the operation of the bevel gear clutch 42. Also, the gear shift 90 is adapted to control the engagement and disengagement of the second clutch 51 and the operation of the gearbox 52. In short, the gear shift 90 is adapted to move the boat forward in one of a plurality of speeds (e.g., four speeds) in a forward drive or move the boat backward in a reverse drive. After starting the electric motor 30, a person may operate the gear shift 90 to transmit rotation of the drive shaft 32 to the propeller 70 via the first shaft 40 and the reduction gear 43. As a result, the boat may slowly move forward or backward to begin its sailing. Thereafter, the person may operate the gear shift 90 to transmit the rotation of the drive shaft 32 to the second shaft 50. And in turn, the gearbox 52 is activated to transmit the rotation of the second shaft 50 to the propeller 70. As a result, the boat moves forward in a cruising speed.

A third switch (e.g., toggle switch) 12 is adapted to supply stored electrical energy of either rechargeable battery assembly 10 to the electric motor 30 via the power controller 20. Also, the auxiliary alternator 31 is electrically connected to the power controller 20. A manual rotational speed controller 21 is adapted to adjust the rotational speed of the electric motor 30 to one of a plurality of speeds via the power controller 20. That is, the drive shaft 32 may rotate at one of the predetermined rotational speeds.

A centrifugal type continuously variable transmission 62 is additionally provided on the third shaft 32. Output, i.e., rotation, of the continuously variable transmission 62 is transmitted to the electrical generator 80 via a belt 83. The higher of the rotational speed of the drive shaft 32 the higher of the reduction of the transmission ratio of the third shaft 60 will be. As such, less torque is transmitted from the drive shaft 32 to the electrical generator 80 via the continuously variable transmission 62 and the belt 83 and more torque is transmitted from the drive shaft 32 to the propeller 70. As a result, the boat may move forward fast while the electrical generator 80 is still generating electricity. This can prevent the electrical generator 80 from being malfunctioned due to high speed movement of the boat.

Each of the rechargeable battery assemblies 10 has a battery voltage measurement device 11. A charging controller 15 is adapted to control the third switch 12, the battery voltage measurement devices 11, and the first and second switches 13, 14. Hence, information about the stored electrical energy of each of the rechargeable battery assemblies 10 can be sent to the charging controller 15 by its battery voltage measurement device 11. For example, if one rechargeable battery assembly 10 (e.g., the rechargeable battery assembly 10 proximate the rotational speed controller 21) is full and the other rechargeable battery assembly 10 is low, then the charging controller 15 may activate to flow current from the transformer 82 to the other rechargeable battery assembly 10 for charging via the second switch 14 and the second switch 13. Moreover, the third switch 12 may be controlled by the charging controller 15 to supply current from one of the rechargeable battery assemblies 10 to the power controller 20. A capacitor 22 of high capacity is provided to interconnect the power controller 20 and the third switch 12. The capacitor 22 is adapted to discharge to supply power to the electric motor 30 when the third switch 12 is switching. Hence, the electric motor 30 may maintain its normal operation.

While the number of the rechargeable battery assemblies 10 is two as shown, it is understood that it may be more than two in practices in which only one rechargeable battery assembly 10 is adapted to supply electric power to the electric motor 30 when the boat is operated and the remaining rechargeable battery assemblies are idle or charged. Preferably, the rechargeable battery assembly 10 comprises a plurality of rechargeable cells. Further, the rechargeable battery assembly 10 can be charged by electrically connecting a charger 16 to the charging terminals of the transformer 82. The charger 16 is further electrically connected to a wall outlet.

While the invention herein disclosed has been described by means of specific embodiments, numerous modifications and variations could be made thereto by those skilled in the art without departing from the scope and spirit of the invention set forth in the claims.

What is claimed is:

1. A power system for an electric boat comprising:

a propeller (70);

an electrical generator (80);

a plurality of rechargeable battery assemblies (10) having a battery voltage measurement device (11);

an electric motor (30) comprising an auxiliary alternator (31), a drive shaft (32), a flywheel (33), and a rotational speed measurement device (34);

a power controller (20) electrically connected to the auxiliary alternator (31);

a first shaft (40) operatively connected to the drive shaft (32);

a first clutch (41) and a bevel gear clutch (42) each operatively connected to the first shaft (40);

a reduction gear (43) being in gear connection to the bevel gear clutch (42);

a second shaft (50) operatively connected to the drive shaft (32);

a second clutch (51) and a gearbox (52) each operatively connected to the second shaft (50);

a third shaft (60) operatively connected to the drive shaft (32);

a third clutch (61) operatively connected to the third shaft (60);

a continuously variable transmission (62) operatively interconnecting the third shaft (60) and the electrical generator (80);

a control panel (81) electrically connected to the electrical generator (80);

a transformer (82) having one end electrically connected to the control panel (81);

a first switch (13) adapted to electrically connect to one of the rechargeable battery assemblies (10) being discharged by switching;

a second switch (14) electrically interconnecting the first switch (13) and the other end of the transformer (82);

a capacitor (22) having one end electrically connected to the power controller (20);

a third switch (12) having one end electrically connected to the other end of the capacitor (22) and the other end adapted to electrically connect to one of the rechargeable battery assemblies (10) being charged by switching;

a charging controller (15) adapted to control the first and second switches (13, 14) and the battery voltage measurement devices (11) for charging one of the rechargeable battery assemblies (10), and control the third switch (12) to supply current from one of the charged rechargeable battery assemblies (10) to the power controller (20) via the third switch (12) and the capacitor (22); and a gear shift (90) adapted to control engagements and disengagements of the first clutch (41), the bevel gear clutch (42), the second clutch (51), and the gearbox (52);

wherein in starting the electric motor (30) the third clutch (61) is not activated if a rotational speed of the drive shaft (32) measured by the rotational speed measurement device (34) does not reach a predetermined value, the power controller (20) gradually increases a current output to the electric motor (30) until the drive shaft (32) rotates at a predetermined rotational speed, the third clutch (61) is activated to transmit rotation of the drive shaft (32) to the electrical generator (80), and the activated electrical generator (80) generates electricity to charge one of the rechargeable battery assemblies (10) being discharged;

wherein in response to activating the first clutch (41) rotation of the drive shaft (32) is transmitted to the first shaft (40), the bevel gear clutch (42) is activated to transmit rotation of the first shaft (40) to the propeller (70) for moving the boat via the reduction gear (43); and wherein in response to moving the boat the first clutch (41) is disengaged and the second clutch (51) is engaged so as to transmit the rotation of the drive shaft (32) to the second shaft (50), and the gearbox (52) is controlled by the gear shift (90) to increase a rotational speed of the propeller (70) until the boat moves in a cruising speed.

2. The power system of claim 1, wherein each of the first and third switches (13, 12) is a toggle switch.

3. The power system of claim 1, further comprising a manual rotational speed controller (21) adapted to adjust the rotational speed of the drive shaft (32) to one of a plurality of predetermined rotational speeds via the power controller (20).

4. The power system of claim 1, wherein in response to starting to move the boat and slowing down the drive shaft (32) the third clutch (61) activates to disengage from the third shaft (60) so as to prevent the third shaft (60) from transmitting its rotation to the electrical generator (80).

* * * * *